US005765069A

United States Patent [19]

Fyson

[11] Patent Number: 5,765,069

[45] Date of Patent: Jun. 9, 1998

[54] PROCESS AND APPARATUS FOR THE DEVELOPMENT OF PHOTOGRAPHIC MATERIALS

[75] Inventor: John Richard Fyson, Hackney, England

[73] Assignee: Eastman Kodak Company, Rochester, N.Y.

[21] Appl. No.: 604,271

[22] Filed: Feb. 21, 1996

[30] Foreign Application Priority Data

Feb. 23, 1995 [GB] United Kingdom ..... 9503570

[51] Int. Cl.[6] ..... G03D 3/02; G03C 5/395

[52] U.S. Cl. ..... 396/571; 396/626; 430/398; 159/47.3

[58] Field of Search ..... 354/299, 324; 396/571, 626; 159/47.3, 29; 430/398, 399

[56] References Cited

U.S. PATENT DOCUMENTS

| | | | |
|---|---|---|---|
| 4,451,132 | 5/1984 | Kishimoto | 354/324 |
| 5,040,013 | 8/1991 | Kurokawa et al. | 354/324 |
| 5,177,521 | 1/1993 | Mogi et al. | 354/324 |
| 5,452,045 | 9/1995 | Koboshi et al. | 354/324 |

FOREIGN PATENT DOCUMENTS

| | | |
|---|---|---|
| 0 223 605 | 5/1987 | European Pat. Off. . |
| 456197 A2 | 11/1991 | European Pat. Off. . |
| 573927 A1 | 12/1993 | European Pat. Off. . |

*Primary Examiner*—A. A. Mathews
*Attorney, Agent, or Firm*—Frank Pincelli

[57] ABSTRACT

A process for the development of photographic materials comprises developing the materials in a bath of developer processing solution and subjecting the used developer solution to a water recovery step comprising distillation or reverse osmosis and using the recovered water to prepare a photographic processing solution or as a compensator for evaporation loss and wherein said used developer solution passed to the water recovery step is free of contaminants such as ammonia or sulphur dioxide present in bleaching and fixing agents. Preferably the used developer solution is subjected to the water recovery without the addition of other photographic processing liquids. The recovered water may be used to prepare developer solution or developer replenisher solution and recycled to the developer processing bath. The invention includes an apparatus for the development of photographic materials and recycling water from the used developer solution which comprises a first tank (2) for holding developer processing solution, a second tank (4) for holding replenisher solution and connected to the first tank (2) so that replenisher solution may be fed thereto, a third tank (10) connected to the first tank (6) for receiving displaced developer solution, characterized in that distillation means (13,14) are provided for recovering water from the displaced solution and means (12) are provided for recycling the distilled water.

6 Claims, 2 Drawing Sheets

PROCESS AND APPARATUS FOR THE DEVELOPMENT OF PHOTOGRAPHIC MATERIALS

FIELD OF THE INVENTION

This invention relates a process for the development of photographic materials in which water is recovered from used developer solution and to an apparatus in which the development is carried out.

Background of the Invention

In the development of photographic materials on a commercial scale the process is frequently carried out continuously. The developer processing solution is contained in a tank and it is necessary to make up the composition of the solution as it is used up by the addition of replenisher solution. However the addition of replenisher solution causes processing solution to be displaced from the processing tank.

Problem to be solved by the Invention

The supply of replenisher solution which may be continuous, and the displacement of developer solution from the tank require significant amounts of water to be supplied to the process. Further the displaced solution has previously been treated as a waste product because it is unsuitable to be returned to the tank containing the developer. However its disposal may present environmental problems.

European Patent Application No 456167 describes a method of recovering the water from waste photographic processing solutions by distillation and recycling the distilled water, for example, to make up bleach fix.

European Patent Application No 573927 reports that some secondary treatment of the distilled water from these solutions is necessary before it can be used as a solvent for colour developer, stabilizer and other processing solutions. Further, it is stated that when the distillation is performed at atmospheric pressure, certain waste and decomposition products accumulate in the distilled water which is thus unsuitable for use as a solvent or evaporation loss compensator.

European Patent Application No 573927 proposes a solution to this problem by carrying out the distillation at a pressure of not more then 900 mmHg, preferably not more than 200 mmHg, and at a temperature of not more than 90° C., preferably not more 60° C. The liquids which are heated to prepare the distilled water in these two patents are mixed solutions obtained by combining different waste solutions from different parts of the photographic process and feeding the combined solutions to the distillation step.

Contrary to expectation, it has now been found that water of sufficiently high quality for the preparation of developer (including developer-replenisher solution) can be obtained by distillation or reverse osmosis from used developer solution provided that the used developer solution is free of contaminants present in bleach and fixing agents. The present invention therefore provides a solution to the problem of the large amounts of water used in the development process by recovering water from the used developer solution and using the recovered water as a solvent to prepare processing solution such as replenisher solution. When the water is recovered by distillation it has been found that it is not necessary to carry out the distillation at reduced pressure.

SUMMARY OF THE INVENTION

According to the present invention, a process for the development of photographic materials comprises developing the materials in a bath of developer processing solution and subjecting the used developer solution to a water recovery step comprising distillation or reverse osmosis and using the recovered water to prepare a photographic processing solution or as a compensator for evaporation loss and wherein said used developer solution passed to the water recovery step is free of contaminants present in bleaching and fixing agents.

According to another aspect of the present invention an apparatus for the development of photographic materials and recycling water from the used developer solution comprises a first tank (2) for holding developer processing solution, a second tank (4) for holding replenisher solution and connected to the first tank (2) so that replenisher solution may be fed thereto, a third tank (10) connected to the first tank (2) for receiving displaced developer solution, characterised in that distillation means (13,14) is provided for distilling water from the displaced solution and means (12) are provided for recycling the distilled water.

Preferably means are provided for passing the distilled water to the second tank (4).

Advantageous Effect of the Invention

The use of water from the used developer solution to prepare a processing solution such as replenisher solution or to compensate for evaporation loss enables the amount of water used in the process to be reduced.

A further advantage is that the removal of water from the used developer solution concentrates the solids and thereby facilitates disposal.

The invention has particular application when the space for the replenisher is at a premium or there is a need to conserve water.

BRIEF DESCRIPTION OF THE DRAWINGS

The invention is illustrated with reference to the accompanying drawings in which.

DETAILED DESCRIPTION OF THE INVENTION

As stated above, the used developer solution should be free of contaminants that are present in bleach or fixing solutions or are formed from such solutions on distillation and may contaminate the recovered water in sufficient amount to have a sensitometric effect on developer solution prepared from such distilled water. Examples of such contaminants are ammonia and sulphur dioxide. Preferably therefore, the used developer is distilled alone i.e. without the addition of any other waste processing solution. This can be carried out by passing the used developer solution from the development processing bath direct to the distillation step or reverse osmosis step without the addition of liquids or effluents from other parts of the photographic process. The used developer solution is conveniently the solution displaced from the development bath by the introduction of the replenisher solution. Although the water can be recovered from the used developer solution by reverse osmosis, it is preferred to recover the water by distillation. The distillation can be carried out at atmospheric pressure or under reduced pressure.

The development process will normally be one process or stage in the series of well known stages in an overall photographic process e.g. development, bleaching, fixing etc and the distilled water prepared from the used developer solution can be used as evaporation loss compensator to other stages of the overall photographic process or to prepare other processing solutions.

The development processing solution may be used as coolant to assist condensation of the vapour in the preparation of the distilled water, for example by being used as the coolant in a condenser. The processing solution is therefore warmed by the condensing liquid, thereby reducing the amount of heat required for the processing solution.

The pressure in the evaporation system may be regulated so that when heating is necessary for the rest of the process, i.e. when it is warming up, distillation is carried out at normal pressure. When the process is at processing temperature the pressure in the evaporating system is lowered so that less heat is needed for distillation and less cooling by the condenser is required.

When the distilled water is used to prepare developer replenisher solution it may be used to dilute developer concentrate or dissolve measured solids.

The development process may be operated continuously and the replenisher solution may be fed to the processing tank continuously or intermittently. References in the present specification to the developer solution being displaced from the bath or tank of developer solution are intended to include the developer solution being withdrawn from the bath or tank.

Figure 1:
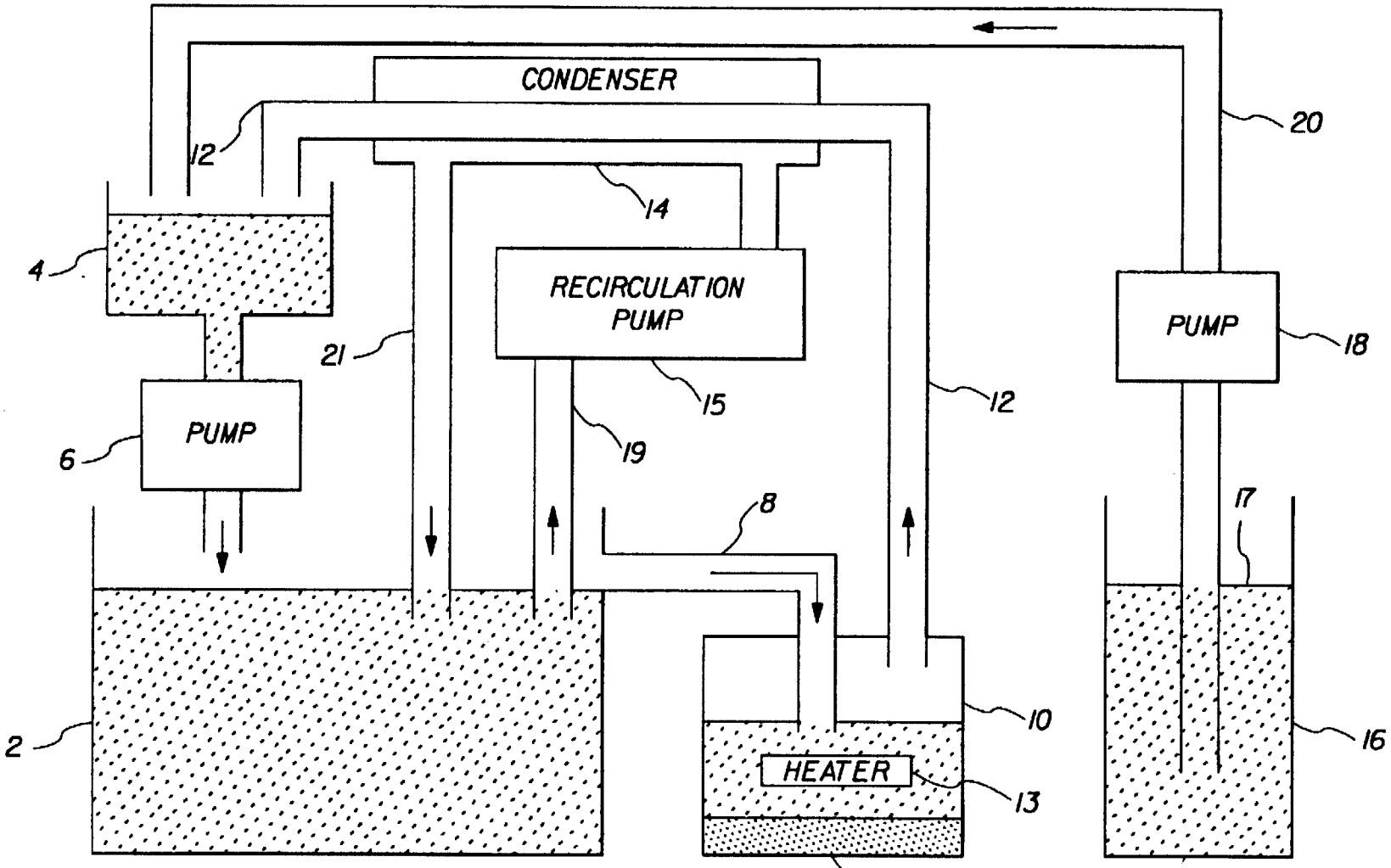
FIG. 1 shows a process scheme in which developer solution is displaced from a processor tank, used to prepare distilled water and the distilled water recycled to a replenisher tank.

Referring to FIG. 1, the apparatus comprises a first tank 2 which contains developer solution and a second tank 4 containing developer replenisher solution. Replenisher solution may be fed to the tank 2 by pump 6. Tank 2 has an outlet 8 through which displaced solution may be passed to a third tank 10 which is provided with a heater 13 and an outlet 12 through which water vapour may be passed to condenser 14 and the condensed vapour passed to the tank 4.

Figure 2:
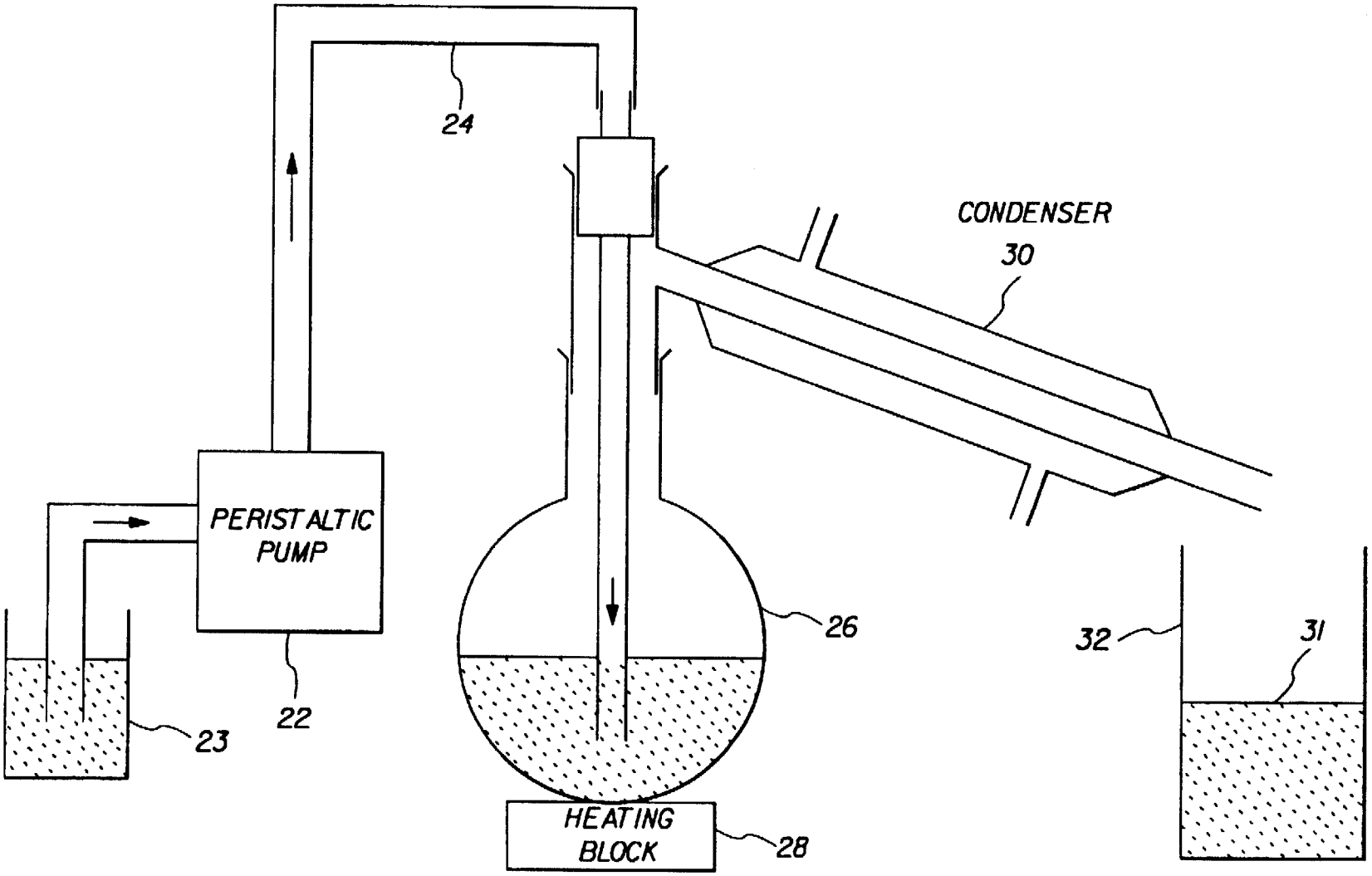
FIG. 2 shows laboratory equipment used to prepare distilled water from seasoned i.e. used developer solution.

The apparatus also includes a further tank 16 for holding replenisher concentrate 17 which may be fed by means of pump 18 and line 20 to the tank 4. In use replenisher liquid is fed from the tank 4 via the pump 6 to the developer processing tank 2. Liquid is displaced from the tank 2 and passes through outlet 8 to the third tank 10 where it is heated and allowed to boil. Solid residue 11 is formed in tank 10. The vapour from the boiling liquid passed through outlet pipe 12 to a condenser 14 from which the condensed vapour is passed to the replenisher tank 4. The condenser 14 is cooled by processor solution withdrawn by line 19 from tank 2 under the action of recirculation pump 15 and the used coolant returned by line 21 to the processor tank 2. Concentrated developer replenisher 17 contained in tank 16 is passed via pump 18 and line 20 to the replenisher tank 4 where it mixes with the condensed vapour. Referring to FIG. 2 seasoned i.e. used developer in vessel 23 is withdrawn by means of peristaltic pump 22 and passed via line 24 to a distillation flask 26 heated by means of a heating block 28. Vapour from the boiling solution is condensed in condenser 30 and the distilled water 31 collected in vessel 32.

The invention is illustrated in the following Example.

EXAMPLE

Samples of seasoned developer were taken from the overflow of a minilab-type processor filled with developer solution of the following composition:

| | |
|---|---|
| sodium metabisulphite | 45.0 g |
| sodium bromide | 3.8 g |
| benzotriazole | 0.21 g |
| phenylmercaptotetrazole | 0.013 g |
| hydroquinone | 25.0 g |
| potassium carbonate | 39.0 g |
| diethylene glycol | 37.0 mls |
| hydroxymethyl methyl Phenidone ® | 0.8 g |
| water to | 1 liter |
| pH adjusted to | 10.4 |

No effluents or other solutions were mixed with these samples and water was distilled from them at atmospheric pressure using the apparatus shown in FIG. 2. The condensed water was used to dilute a concentrate of the above developer 1+2. The same concentrate was separately diluted 1+2 with demineralized water.

Strips of scanner film were exposed to a neutral density wedge with a white light source and processed in a low volume processor of the type described in European Patent Application No 929223787.3 at 35° C. for 30 seconds, filled with each of the developer solutions in turn. The strips of film were fixed for 30 seconds at 35° C. in a bath of fixer having the following composition:

| | |
|---|---|
| ammonium thiosulphate | 200 g |
| sodium sulphite | 12 g |
| acetic acid | 10 mls |
| water to | 1 liter |
| pH adjusted to | 5.0 |

The film strips were then washed in three baths of 15 seconds each and then allowed to dry. The strips were read with a densitometer and standard parameters calculated. The results are shown in the Table below. Strips of KODAK Contact 2000 Film CB4 (Registered Trade Mark) were treated in the same way except that they were exposed to a wedge using a mercury UV lamp.

TABLE

| | Film 1 | | Film 2 | |
|---|---|---|---|---|
| | water diluted | distillate diluted | water diluted | distillate diluted |
| Dmin | 0.200 | 0.020 | 0.017 | 0.017 |
| Dmax | 5.97 | 6.00 | 5.613 | 5.624 |
| EC | 9.28 | 9.26 | 6.75 | 6.77 |
| LSC | 5.31 | 5.29 | 3.11 | 3.19 |
| 06CR | 209.6 | 209.1 | 219.5 | 220.0 |
| PDP | 4.67 | 4.69 | 4.31 | 4.34 |

Film 1 was KODAK Contact 2000 CB4® film.
Film 2 was KODAK IMAGELITE ESY® Scanner film.
EC means effective contrast and is the gradient of the line which is the best fit to the sensitometric curve. LSC means lower scale contrast at 0.6 above fog.
06CR means speed at 0.6 above fog.
PDP means practical density.
All the above terms are well known in the art.

The results show that there was no significant difference in sensitometric properties between developer solutions made with demineralized water and water distilled from used developer solution.

It follows that fresh developer solution can be made from the distillate prepared from used developer solution.

It is to be understood that various other changes and modifications may be made without departing from the scope of the present invention. The present invention being defined by the following claims:

Parts List:

2,4,10,16 . . . tanks
6,18,22 . . . pumps
8,12 . . . outlet
11 . . . solid residue
13 . . . heater
14 . . . condenser
15 . . . recirculation pump
17 . . . replenisher concentrate
19,20,21,24 . . . lines
26 . . . distillation flask
28 . . . heating block
30 . . . condenser
31 . . . distilled water
32 . . . vessel

I claim:

1. A process for the development of photographic materials which process comprises developing the materials in a bath of developer processing solution and subjecting used developer solution to a water recovery step comprising distillation at atmospheric pressure and using the recovered water to prepare a photographic processing solution or as a compensator for evaporation loss and wherein said used developer solution passed to the water recovery step is free of contaminants present in bleaching and fixing agents.

2. A process as claimed in claim 1 wherein the used developer solution is subjected to distillation without the addition of other photographic processing liquids.

3. A process as claimed in claim 1 wherein the used developer solution is solution displaced from the developer bath by the introduction of developer replenisher and the displaced solution is passed direct to the water recovery step.

4. A process as claimed in claim 1 wherein the recovered water is used to prepare the developer solution.

5. A process as claimed in claim 4 wherein the recovered water is used to prepare developer replenisher solution.

6. A process as claimed in claim 1 wherein the developer processing solution is used as coolant to assist condensation in the distillation.

* * * * *